United States Patent [19]

Saunders

[11] 4,054,227

[45] Oct. 18, 1977

[54] SELECTIVE COATING CHARACTERISTIC TINPLATED STEEL CANS

[75] Inventor: William T. Saunders, Weirton, W. Va.

[73] Assignee: National Steel Corporation, Pittsburgh, Pa.

[21] Appl. No.: 615,684

[22] Filed: Sept. 22, 1975

Related U.S. Application Data

[62] Division of Ser. No. 387,043, Aug. 9, 1973, Pat. No. 3,934,527.

[51] Int. Cl.[2] ..... B65D 23/02

[52] U.S. Cl. ..... 220/64; 426/126; 426/131

[58] Field of Search ..... 220/64, 67, 70; 426/126, 131, 327, 398

[56] References Cited

U.S. PATENT DOCUMENTS

| | | | |
|---|---|---|---|
| 2,327,127 | 8/1943 | Rath | 220/64 |
| 2,412,528 | 12/1946 | Morrell | 220/64 |
| 2,530,413 | 11/1950 | Warth | 220/64 |
| 2,881,516 | 4/1959 | Hull et al. | 29/407 |
| 3,040,781 | 6/1962 | Reymann et al. | 220/64 X |
| 3,194,428 | 7/1965 | Dereich | 220/64 |
| 3,268,344 | 8/1966 | Kamm | 220/64 X |
| 3,360,157 | 12/1967 | Bolt et al. | 220/64 |
| 3,369,694 | 2/1968 | Mauser et al. | 220/67 |
| 3,577,753 | 5/1971 | Shah et al. | 72/41 |
| 3,655,349 | 4/1972 | Shah et al. | 220/64 X |
| 3,693,828 | 9/1972 | Kneusel et al. | 220/70 X |
| 3,760,751 | 9/1973 | Dunn et al. | 113/120 A X |

*Primary Examiner*—Stephen Marcus

*Attorney, Agent, or Firm*—Shanley, O'Neil and Baker

[57] ABSTRACT

By predetermined selection of tin coating weight in the manufacture of electrolytically tinplated continuous steel strip, cup formation of sheet metal blanks cut from such tinplated flat rolled steel with the selected tin coating weight disposed internally, selective reduction of sidewall gage and coating weight, maintenance of tin coating weight on the interior surface of the bottom wall, and selective organic coating, the present invention enables production of special container packs, previously limited to three-piece containers, from unitary seamless can bodies. Selected tin coating weight on the interior surface of the bottom wall of the can body is maintained throughout the manufacturing process and this surface is exposed to container contents. The sidewall interior surface of the can body is protected from exposure to container contents by an organic coating.

9 Claims, 5 Drawing Figures

FIG. 1
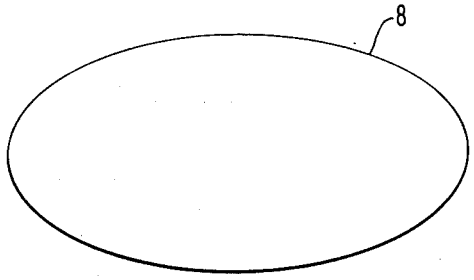
FIG. 2
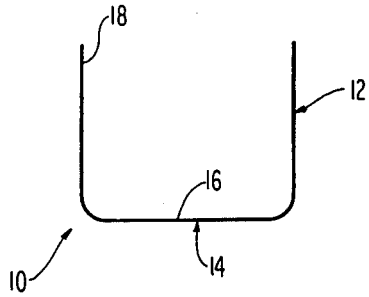
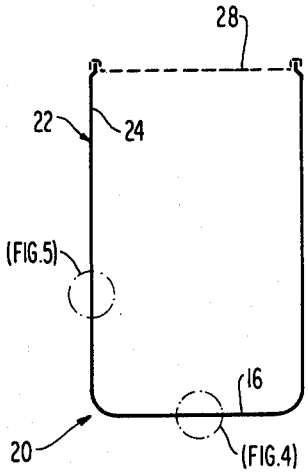
FIG. 3
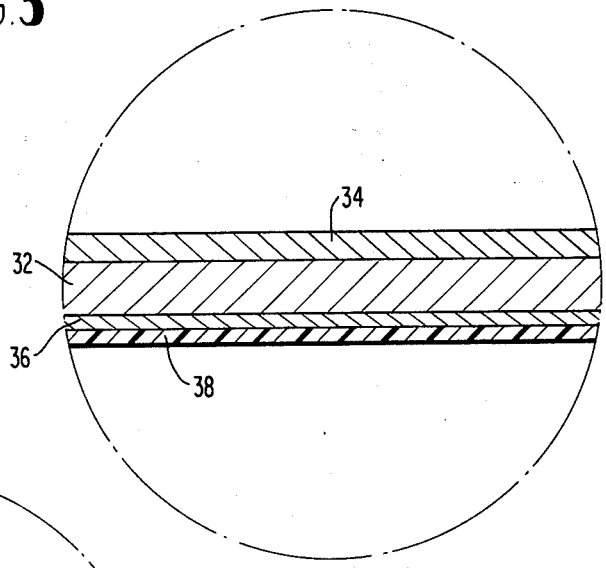
FIG. 4
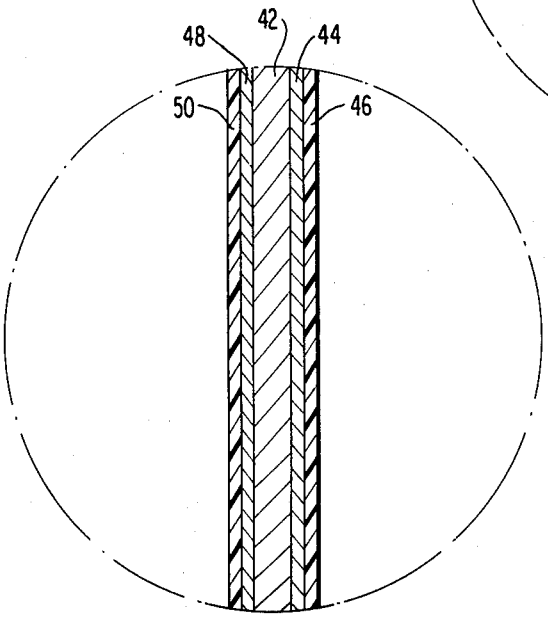
FIG. 5

SELECTIVE COATING CHARACTERISTIC TINPLATED STEEL CANS

This is a division, of application Ser. No. 387,043 filed Aug. 9, 1973, now Pat. No. 3,934,527.

This invention is concerned with manufacture of a unitary flat rolled steel can body having surface areas of selective coating characteristics and with containers for special food products.

In the canning of certain fruits and vegetables, such as pineapples, asparagus, celery, and others, special container pack characteristics require an exposed tin surface in contact with container contents in order to maintain proper coloration by means of a bleaching action. One objectionable feature is that the exposed tin surface can acquire a mottled appearance which, although harmless, is unattractive. In the past, the inner surface of the top closure panel, and usually the bottom closure panel, had been coated with an organic coating in an attempt to at least partially overcome this objectionable appearance aspect.

However this approach of the prior art required that a large surface area, i.e. the sidewall, be coated with a heavy coat of tin to provide adequate shelf life. This substantially increased the cost of such containers. Further, these special container packs were, for economic reasons explained later, limited to three-piece containers with seamed sidewalls and chime seams at the top and bottom endwalls.

Novel concepts of the present invention make special container pack characteristics available in two-piece containers utilizing a seamless unitary can body and a single end closure. More specifically, the invention makes possible utilization of a drawn and ironed container body while maintaining desired product protection and shelf life. Moreover, such special surface characteristics are available with significant savings in tin.

Part of the invention resides in overcoming technical and economic obstacles in order to make drawn and ironed unitary can bodies practicable for the special container packs of interest. The special container packs of interest had been manufactured from three-piece containers and the inner sidewall had a heavy coat tin layer to provide adequate shelf life. Also, it was established that unitary can bodies could not provide sufficient tin coating weight for all types of container contents because of the sidewall reduction during ironing. The sidewall ironing reduced not only the thickness gage of the sidewall sheet metal but also reduced the thickness of the tin coating in an amount corresponding to the reduction in thickness gage of the sidewall sheet metal. In effect, the reduction in the thickness of interior sidewall tin coating ruled out use of drawn and ironed unitary can bodies for the special container packs of interest. That is, the heavy tin coating required on an entire blank, in order to allow for the reduction in thickness during ironing while still providing protective tin coating of sufficient thickness for adequate shelf life, made an otherwise desirable product economically impractical.

More pointedly, the tin coating weights available on flat rolled steel played a part in blocking development prior to the present invention. For example, it would not have been possible, with the tinplated steel available from continuous strip steel electrotinplating lines, to obtain a sufficiently thick tin coating so that an adequate tin coating could be maintained, after ironing, to provide require shelf life for certain types of container contents.

The present invention overcomes these obstacles by providing a uniformly and adequately coated tin surface, of reduced surface area, available for exposure to container contents while otherwise protecting the larger remaining surface area of the container body interior. As a result, economic and appearance advantages of the unitary can body are available for the special container products of interest while, at the same time, providing for adequate shelf life.

The accompanying drawings which form a part of a more detailed presentation of the invention include the figures briefly described below:

FIG. 1 is a schematic perspective view of a sheet metal blank used in forming the container body of the present invention, FIG. 2 is a schematic cross-sectional view of a cup drawn from the sheet metal blank of FIG. 1, FIG. 3 is a schematic cross-sectional view of a unitary container body in which the sidewalls have been ironed with an endwall closure shown in dotted lines.

FIG. 4 is an exploded cross-sectional view of a portion of the bottom wall of a unitary container body embodying the invention, and FIG. 5 is an exploded cross-sectional view of a portion of the sidewall of a unitary container body embodying the invention.

In practice of the present invention a sheet metal blank 8 as shown in FIG. 1 is cut from flat rolled steel which has been coated in a continuous strip electrotinplating line. The tinplated coating of the sheet metal blank is substantially uniform on each surface, however the strip can be differentially coated. That is, the blank can have a differing coating weight of tin on each surface and, the invention can be carried out with coating on only one surface of the flat rolled strip.

In accordance with the invention, a preselected tin coating is applied to one surface of the flat rolled steel. The sheet metal blank 8 of FIG. 1 is then drawn by known means and methods into a cup-like configuration while maintaining a preselected tin coating weight on the interior bottom wall. Cup 10 of FIG. 2 comprises a unitary sidewall 12 and bottom wall 14. Interior surface 16 of the bottom wall 14 has a substantially uniform tin coating of the same preselected thickness as existed on the original blank.

FIG. 3 illustrates the unitary can body resulting after ironing of the sidewall 12 of the drawn cup 10 of FIG. 2. The drawn and ironed unitary can body 20 of FIG. 3 has substantially the same internal diameter as that of the drawn cup 10 of FIG. 2. Only the sidewalls have been lengthened (changed in thickness) by ironing. The ironing of the sidewalls is carried out by a known method which reduces the thickness of the cup sidewall, to produce the increased height sidewall 22 of the drawn and ironed container body 20, while maintaining the preselected tin coating weight on the interior surface of the bottom wall.

In accordance with the invention, neither the drawing process in forming the cup 10 of FIG. 2 nor the ironing process forming the unitary can body 20 of FIG. 3 change the uniform, heavy-coat, preselected tin coating existing on the interior bottom wall surface 16. However, inherently, ironing of the cup sidewall to produce the elongated sidewall 22 of unitary can body 20 of FIG. 3 substantially reduces the tin coating weight on the interior sidewall surface 24, as well as any coating on the exterior surface. The tin coating on the sidewall 22 is reduced in thickness in proportion to the reduction in thickness of the flat rolled base metal of the sidewall during the ironing process. In practice, this reduction of thickness is in the range of about 25% to about 75% of the original thickness.

Practical limitations imposed by continuous strip steel electroplating lines limit the amount of tin-coating available on flat rolled steel. The maximum tin coating weight generally available, as published by steel producers, is 1.35 pounds of tin per base box (217.78 sq. ft.) on both surfaces of the substrate. Assuming a heavier tin coating of about 1.50 pounds per base box could be produced, it would result in a coating thickness of tin on one surface of about ninety micro-inches. Reducing the sidewalls at some locations by about 75% during ironing would reduce the effective tin coating weight, on at least a major portion of the sidewall, below that required for certain container products to provide adequate shelf life. It should be noted that shelf life is limited by the thinnest tin coating existing on any exposed interior portion of the container. Therefore a food product requiring thirty micro-inches of tinplate coating on one surface (about a half pound per base box) for adequate shelf life could not be canned in a unitary drawn and ironed can body by the prior art practices which exposed the interior sidewall to container contents. A 75% reduction in the sidewall thickness of flat rolled steel, coated with the maximum electrolytic tin coating weight available, would have left insufficient tin on the interior sidewall for adequate shelf life.

To overcome the various obstacles which blocked utilization of drawn and ironed containers in this field, the invention provides for presentation of a uniform, heavy-coat, tinplated surface of preselected coating thickness for contact with container contents. The preselected coating is not disturbed during manufacture of the can body. In addition, the exposed tin surface is a smaller area than that of the prior art thus providing an overall saving in tin and, the larger surface area normally exposed in the prior art is otherwise protected from exposure to container contents. In the practice of the present invention the desired tin coating thickness for shelf life of a particular food product is preselected from the outset, e.g. from the start of the continuous strip electrolytic tinplating operation.

Further this preselected coating weight is maintained during the manufacturing process. After selection of the required tin coating weight for desired shelf life, the sheet metal surface with this coating weight is maintained on the interior surface of the container during the manufacturing process. In the drawing operation to form the cup 10 of FIG. 2, this preselected coating weight covers the interior of the bottom wall surface. This coating weight on the interior bottom wall surface is maintained during the drawing operation. Also, during the sidewall ironing steps this preselected tin coating weight on the interior bottom wall surface is maintained so that the required coating weight for the selected shelf life is maintained on the interior bottom wall surface throughout the manufacturing process. In practice this coating weight is selected to vary between a minimum of about ten micro-inches of tin on this interior surface to a maximum coating thickness of about 90 micro-inches.

In the manufacturing process, after ironing, the interior sidewall surface is selectively lacquered with a protective coating, such as a clear or pigmented organic coating. Typical protective organic coatings include oleo-resinous lacquers, Epon (trademark of Shell Chemical Corp.) epoxy-type resins, phenolics, modified epoxy-type resin phenolics, vinyls, and acrylics. This protective coating to prevent exposure of the interior sidewall is selectively applied while maintaining the interior bottom wall tinned surface exposed. Applying the organic coating to the interior sidewall can be carried out by known means, for example by selective spraying of the protective coating on only the interior sidewall surface. The interior bottom wall tin surface is not coated and provides a heavy-coat tin coating for exposure to container contents to provide the special characeristics necessary for the product packs of interest.

The sheet metal from which the blank is cut can be differentially coated in accordance with the invention so that the exterior surface of the unitary can body can have a very light (flash) tin coating or be substantially free of tin coating. The economics resulting from this additional savings of tin are obvious. In addition the present invention makes unitary can bodies practicable for the special product packs of interest. In one embodiment of the present invention, the entire exterior surface is protected with outside coating, e.g. with the final exterior enamel or printing coat. In this way the advantages in appearance and economics of a seamless can body are available for the special product packs of interest which had previously been limited to three-piece cans.

The closing of the remaining end of the unitary container body can be carried out by conventional chime seaming operations. Top endwall closure 28 is shown in dotted lines in FIG. 3. Endwall closure 28 is protectively coated on its interior surface with an organic coating for appearance and also for economic purposes i.e. saving of tin coating. Only the interior bottom wall tin is exposed to container contents and this tin coating weight is preselected and maintained during manufacture to provide the necessary protection and shelf life.

After ironing, the sidewall is trimmed to be of uniform height and the open end of the container body is, preferably, necked-in. This accommodates the chime seam and provides a uniform diameter container throughout the height of the container. The chime seam secures endwall 28 to the necked-in portion of the sidewall.

The expanded cross-sectional view of FIG. 4 shows in detail the results of the invention on the bottom endwall of the drawn and ironed container. The flat rolled steel base metal 32 will have its original gage which, in practice, is selected to be in the range of about 0.010 inches to about 0.015 inch thickness. The steel base metal is conventional drawing and ironing container stock, i.e. a flat rolled steel of very low carbon content. Exposed interior surface tin coating layer 34 will have its original coating thickness of tin, i.e. in the range of about ten micro-inches to about 90 micro-inches.

Selection is available on the exterior surface of the bottom wall. Tin coating layer 36 can be substantially thinner than interior tin coating layer 34 through use of differential plating of the flat rolled steel. This exterior surface may have a flash coating of tin or can be substantially free of tin coating since; in at least one embodiment, this exterior surface can be protected by coating 38 such as enamel. In practice the exterior coating on the steel substrate can be tin only, exterior enamel only (although a flash coating of tin is generally desirable for rust-free handling of flat rolled steel stock), or a combination of tin and enamel. This exterior bottom surface can be readily and adequately protected with tin only since the coating weight applied originally will not change during the can manufacturing steps described as part of the present invention.

FIG. 5 shows results of the invention in a crosssectional view of the ironed sidewall of a unitary drawn and ironed can body of FIG. 3. The steel base metal 42 has been substantialy reduced in thickness gage by the ironing to a thickness in the range of about 25% to about 75% of the thickness of the original gage presented by the bottom wall substrate 32 of FIG. 4. Similarly the interior sidewall tinplated coating 44 has been reduced 25% to 75% by the ironing operation. An organic protective coating 46 is applied over the thinned tin coating on the interior surface to prevent exposure of such thin tin coating to container contents. On the exterior surface a light tin coating 48 remaining from an original differential coating operation, or substantially no tin coating, may remain. This exterior surface of the sidewall can be protected with exterior enamel coating 50. The options on the exterior surface of the sidewall could encompass those enumerated in relation to the exterior surface of the bottom wall, however, because of the thinning of any sidewall tin coating, a protective enamel coating is preferred and generally required for long-term appearance requirements.

Various selections are available in the light of the above disclosure, therefore the scope of the invention is to be defined from the appended claims.

What is claimed is:

1. A one-piece sheet metal can body for special container packs requiring exposure of container contents to a tin surface while protecting remaining interior surfaces of the can body from contact with container contents, such special container pack can body having a bottom wall and unitary sidewall extending longitudinally in one direction from the bottom wall, the bottom wall and sidewall comprising flat rolled steel coated on interior surface of the bottom wall and sidewall with tin, the bottom wall sheet metal having a substantially uniform thickness gage between about 0.010 inch and 0.015 inch, the interior surface of the bottom wall having a substantially uniform tin coating between at least ten microinches in thickness and about 90 micro-inches in thickness, the sidewall being ironed and comprising over a major portion of its area a substantially thinner interior surface tin coating than the bottom wall, and further including a protective organic coating on substantially the entire interior surface of the sidewall to substantially eliminate contact of container contents with the sidewall, while the interior surface of the bottom wall provides an exposed tin coating for contact of such tin coated surface with container contents.

2. The can body of claim 1 in which the flat rolled steel of the bottom wall has a uniform thickness gage between about 0.010 inch and 0.015 inch.

3. The can body of claim 1 in which the substantially uniform tin coating on the interior surface of the bottom wall is in the range of ten micro-inches to about 90 microinches in thckness.

4. The container body of claim 1 in which at least a major portion of the ironed sidewall has a thickness in the range of about 25% to about 75% of the thickness of the bottom wall and the thickness of the interior surface sidewall tinplate coating of such portion is correspondingly about 25% to about 75% of the thickness of the tinplate coating on the interior surface of the bottom wall.

5. The can body of claim 1 in which the protective organic coating of the interior surface of the sidewall is selected from the group consisting of oleo-resinous lacquers, epoxy-type resins, phenolics, modified epoxy-type resin phenolics, vinyls, and acrylics.

6. The can body of claim 1 in which the exterior surface of the bottom wall has at least a flash coating of tin.

7. The can body of claim 1 in which exterior surfaces of the bottom wall and sidewall are substantially completely coated with a protective coating such as enamel.

8. The can body of claim 1 in which the sidewall defines an open end and further including an end closure for such open end having an interior surface, the interior surface of such end closure having an organic protective coating covering completely its area exposed to container contents.

9. The structure of claim 8 in which sidewall sheet metal contiguous to the open end of the sidewall is necked-in to a smaller diameter than the remainder of the sidewall and the end closure is joined to the necked-in sidewall sheet metal by a chime seam.

* * * * *